US005133164A

United States Patent [19]

Legler

[11] Patent Number: 5,133,164

[45] Date of Patent: Jul. 28, 1992

[54] POLE ANCHORING SYSTEM

[75] Inventor: Steve Legler, Westmount, Canada

[73] Assignee: Tri-Steel Industries Inc., Montreal, Canada

[21] Appl. No.: 786,520

[22] Filed: Nov. 1, 1991

Related U.S. Application Data

[63] Continuation-in-part of Ser. No. 627,351, Dec. 14, 1990.

[51] Int. Cl.[5] ..... E02D 5/74; E04C 5/30

[52] U.S. Cl. ..... 52/165; 52/298; 52/704; 52/726

[58] Field of Search ..... 52/165, 298, 704, 726, 52/295, 155

[56] References Cited

U.S. PATENT DOCUMENTS

| | | | |
|---|---|---|---|
| 1,438,074 | 12/1922 | Welch | 52/165 |
| 1,486,594 | 3/1924 | Malone | 52/298 |
| 3,514,911 | 6/1970 | Preradovich | 52/298 |
| 4,099,354 | 7/1978 | De Pirro | 52/146 |
| 4,218,858 | 8/1989 | Lerner | 52/165 |
| 4,455,795 | 6/1984 | Cole | 52/155 |
| 4,598,512 | 7/1986 | Chapman | 52/165 |
| 5,060,435 | 10/1991 | Bogdanow | 52/298 |

*Primary Examiner*—David A. Scherbel
*Assistant Examiner*—Robert Canfield
*Attorney, Agent, or Firm*—Oblon, Spivak, McClelland, Maier & Neustadt

[57] ABSTRACT

A pole anchoring device for supporting large diameter poles vertically over a hard surface such as rock, concrete or the like. The device comprises three or more harness members which are interconnectable to one another about a base section of a pole. Each harness member has a pole engaging section for attachment against a pole and a bolt support section spaced outwardly from the pole engaging section. An anchor bolt is guidingly positioned in the bolt support section of each of the harness members and extends along an axis substantially parallel to the axis of the pole and spaced a predetermined distance away from the bolt support section. An anchoring assembly is secured to the anchor bolt and disposed below the bolt support section. The anchoring bolt has an engageable top end portion which extends in a top section and partly above the bolt support section for engagement by a nut whereby to impart axial displacement of the anchor bolt in an upward direction to actuate the anchoring assembly to anchor a lower end of the anchor bolt in a bore hole made in the hard surface and spaced adjacent the pole.

22 Claims, 4 Drawing Sheets

POLE ANCHORING SYSTEM

This application is a Continuation-in-Part of U.S. Application Ser. No. 07/627,351 filed on Dec. 14, 1990.

BACKGROUND OF INVENTION

1. Field of the Invention

The present invention relates to a pole anchoring device for supporting large diameter poles vertically over a hard surface such as rock, concrete or the like and wherein the device comprises a harness assembly interconnectable about a base section of the pole to support spaced apart anchor bolts disposed parallel to the pole and a predetermined distance outwardly therefrom.

2. Description of Prior Art

In U.S. Pat. No. 4,218,858, there is described a pole anchoring device which is strapped about the lower portion of a wooden pole whereby to support that pole vertically over a rock surface. This anchoring device has been primarily used for anchoring small diameter wooden poles such as electrical distribution or telephone poles. However, with very large diameter poles of 20" or more, the anchoring bolt would be subjected to a lot of stress at pole deflection loads of 5° to 20°.

I have therefore devised a new anchoring assembly wherein I can retain the anchor bolt attached to the bottom section of the pole and spaced outwardly therefrom whereby to greatly increase the retention force of the pole anchoring device. Also, a new harness has been developed for increased contact with the pole to provide better retention of the pole when subjected to lateral loads. The entire assembly is also symmetrical and made without any weld joints which could give way when subjected to high working load due to the deflection of these large poles.

Another feature of my pole anchoring device is that my harness consists of modular or universal size members which are adjustable to permit interconnection of a plurality of these about a pole depending on the diameter of the pole or else simply to increase the anchor strength of the pole.

SUMMARY OF INVENTION

It is therefore a feature of the present invention to provide a pole anchoring device for supporting poles vertically over a hard surface, such as rock, concrete or the like, and wherein the device is comprised of a harness assembly connected about a base section of a pole to be supported on a hard surface. Connecting means is provided to immovably secure the harness assembly about the base section. The harness assembly is comprised of harness members each having a pole engaging section for abutment against a pole and a bolt support section spaced outwardly from the pole engaging section. An anchor bolt is guidingly positioned in the bolt support section of each of the harness members and extends along an axis substantially parallel to the axis of the pole and spaced a predetermined distance away from the bolt support section. Anchoring means is secured to the anchor bolt and disposed below the bolt support section. The anchor bolt has an engageable top end portion extending in a top section and partly above the bolt support section for engagement by bolt engaging means to impart axial displacement of the anchor bolt in an upward direction to actuate the anchoring means to anchor a lower end of the anchor bolt in a bore hole formed in the hard surface and spaced adjacent the pole.

According to a still further broad aspect of the present invention, there is provided a pole anchoring member for supporting metal poles vertically over a hard surface such as rock, concrete or the like. The pole anchoring member comprises a metal plate bent to define an elongated U-shaped brace having a straight outer elongated trough portion and outwardly tapering opposed side walls. The side walls each have an outwardly angulated end section to define a pole connecting flange on each side of said trough portion for securement to a bottom outer section of a metal pole. An elongated anchor bolt is guidingly receivable in and extending through the trough portion along an axis substantially parallel to the axis of a pole to be anchored by two or more of the pole anchoring members and spaced a predetermined distance away from the bottom outer section of the pole. The anchor bolt has anchoring means in a lower end portion thereof for anchoring in a bore hole formed in the hard surface. The anchor bolt further has an engageable top end portion extending above the trough outermost portion of the brace for engagement by a bolt engaging means to impart axial displacement of the anchor bolt in an upward direction to actuate the anchoring means to anchor a lower end of the anchor bolt in the bore hole and to support the pole vertically on the hard surface.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
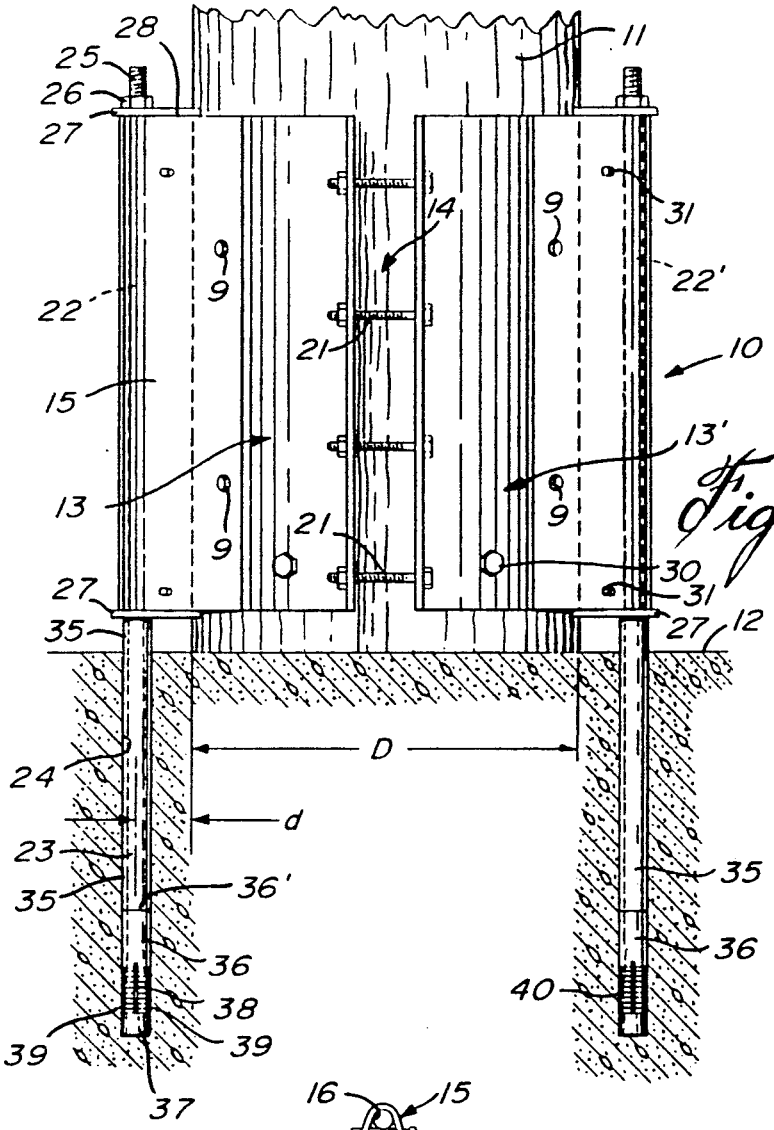
FIG. 1 is a side view illustrating the pole anchoring device of the present invention as connected to a base section of a large diameter pole to support the pole over a rock surface.
Figure 2:
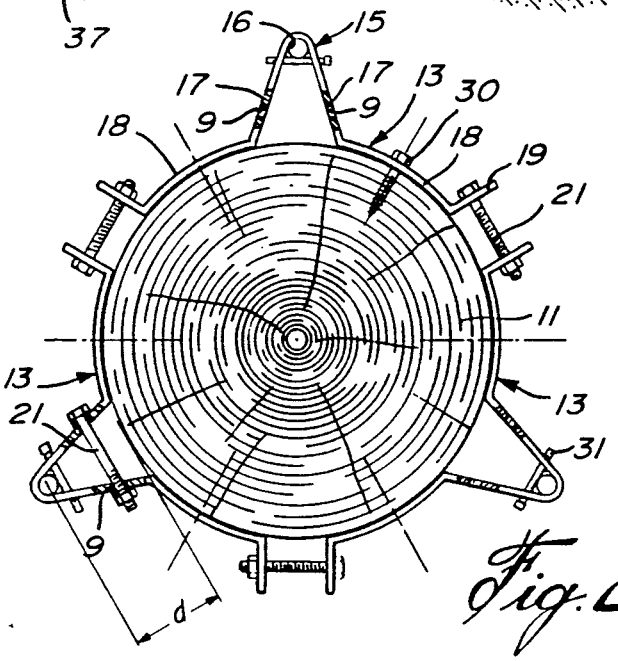
FIG. 2 is a cross-section view of the pole anchoring device illustrated in FIG. 1 illustrating the configuration of the harness members.

Referring now to the drawings, and more particularly to FIGS. 1 and 2, there is shown generally at 10, the pole anchoring device of the present invention for supporting a large diameter pole 11, for example anywhere from 14" to b 43", vertically over a hard rock surface 12. The medium or surface 12 could be solid rock, a concrete bed or any other hard medium. The pole may be a wooden pole or poles made of concrete, steel or any other material.

The pole anchoring device 10 comprises a harness assembly formed by three or more harness members 13, interconnectable to one another about a base section 14 of the pole 11. As can be better seen from FIG. 2, each of the harness members 13 is formed from a metal plate, herein a galvanized steel plate, and shaped to define an outer channel section 15 having a bolt support section 16 in a trough outermost portion thereof. As hereinshown, the outer channel section is formed as a V-shaped channel section with opposed side walls 17 being outwardly inclined. These inclined wall sections also merge within a respective one of opposed curved wall sections 18 which each constitute a pole engaging section for attachment against the pole 11. At the end of these curved wall sections 13, there is formed a connecting flange 19 and these flanges are provided with holes 20, see FIG. 3, whereby to receive therethrough connecting bolts 21 to secure opposed harness members, such as 13 and 13' in FIG. 1, together about the circumference of the pole 11. The harness members 13 are symmetrical and therefore universal. At least two further holes 9 are spaced apart in vertical alignment in each of the opposed side walls 17 and transversely aligned in pairs to receive a bolt, herein one of the connecting bolts 21, temporarily therein to compress the side walls 17 closer together to provide adjustability of the harness about a pole. By compressing the side walls 17, the harness members 13 will deform to adapt to the slight taper that may exist in the pole such that the curved wall sections 18 contact the pole throughout its length.

As is also illustrated in FIG. 1, a long anchor bolt 22 is guidingly positioned in the outermost bolt support section 13 and extends parallel to the pole 11 and to the other bolts 22' and spaced a distance "d" from the outer side wall of the pole 11. This spacing provides for more stability and greater resistance to pole deflection when the pole is subjected to lateral loads.

The anchor bolt 22 has an anchoring assembly 23 in a bottom end thereof with the assembly 23 extending into a bore hole 24 drilled in the rock surface 12. The top end portion of the anchor bolt has an engageable end portion and, as hereinshown, constituted by a threaded upper end portion 25 about which a nut 26 is in threaded engagement and arrested on a gripper spacer or washer element 27 supported across the top edges 28 of the outer channel section 15 and in contact with the pole. By threading the nut 26, the bolt 25 will move axially upwards whereby to actuate the anchoring assembly 23 to anchor a lower end of the anchor bolt 22 in the bore hole 24. FIG. 2 gives a better illustration of the positioning of the bolts relative to the pole.

Figure 3:
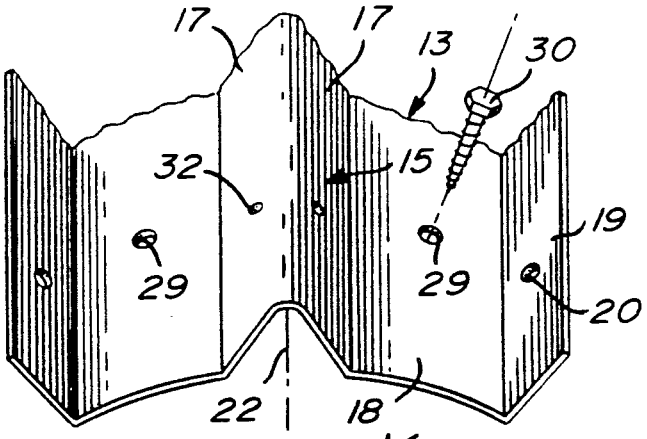
FIG. 3 is a fragmented end view showing more details of the harness member.
Figure 4:
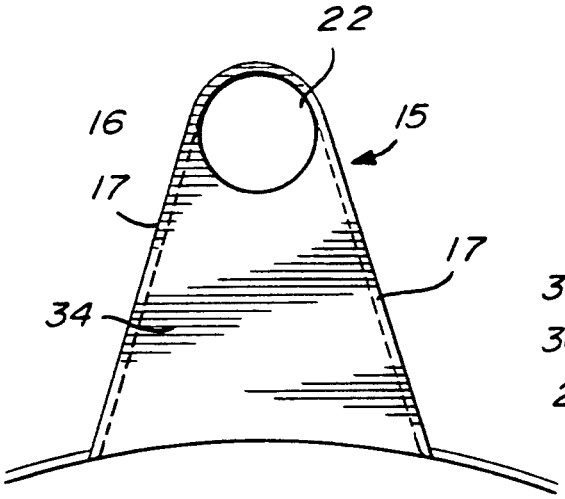
FIG. 4 is an enlarged view showing the construction of the outer channel section of a harness member and alternate guide means to maintain the anchor bolt in the outermost portion of the outer channel section.
Figure 5:
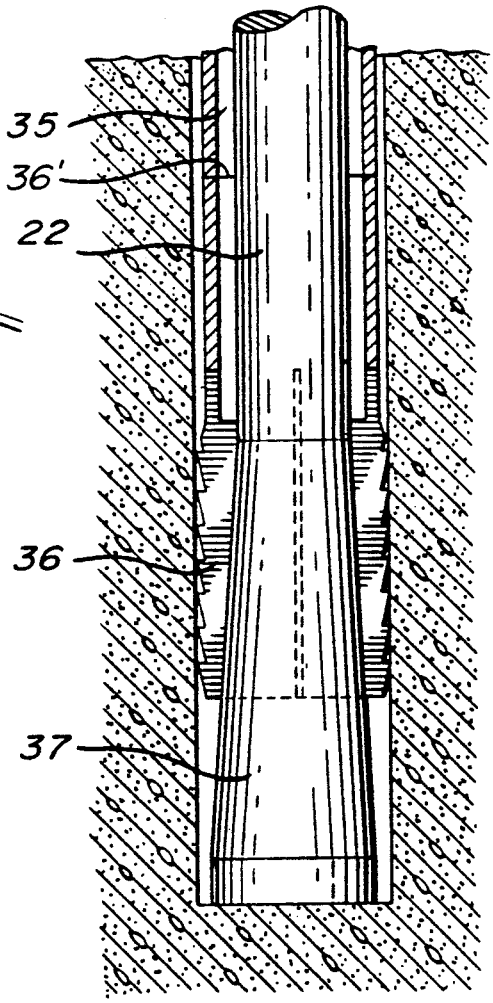
FIG. 5 is a section view showing the bolt anchor construction.

Referring now additionally to FIGS. 3 to 5, it can be seen that the harness members 13 are also provided with arresting means in the form of connecting holes 29 also disposed spaced apart along the wall sections 18 whereby to receive therethrough lag bolts 30 which are threaded or driven into the pole 11, if the pole is a wooden pole, as shown in FIG. 2. Alternate arresting means can be provided as is obvious to a person skilled in the art.

As can be seen from FIG. 1, a plurality of bolts 21 can be secured along the flanges 19 at regular spaced intervals in order to place the harness members in compression retention about the base section 14 of the pole 11. Guide means in the form of spaced apart guide bolts 31 extend across the outer channel section spaced adjacent the trough outermost portion 16 whereby to captivate the bolt 22 in this outer trough portion 16. Alternate guide means may also be provided. Aligned holes are punched from the side walls 17, as shown in FIG. 3, whereby to receive the guide bolts 31 thereacross.

Abutment means in the form of a plate 34 (see FIG. 4) or a gripper spacer 27 is supported over the top and bottom ends of the opposed walls 17 of the outer channel section 15 whereby to provide abutment for the nut 26 in the top end and for the end of the sleeve section 35 of the anchoring assembly 23. As shown in FIG. 1, the sleeve section 35 may extend a few inches above the bore hole 24 so that the sleeve also provides added resistance to lateral bending loads on the pole. The sleeve section 35 is made of heavy gauge steel and is in close fit in the bore hole 24. This also positions the harness assembly a little higher on the base section 14 of the pole for added resistance to the bending moment.

As can be seen in FIGS. 1 and 5, the anchoring assembly comprises a bottom expansion shell 36 which slides over the bolt and is arrested by the conical bottom end 37 of the anchor bolt 22. The sleeve section 35 sits on this shell 36 and forms an isolation joint 36' therewith. This expansion shell is slit, as at 38, to provide expansion wall sections 39 which have gripping ridges 40 on the outside wall thereof to grip with the side wall of the bore hole 24 when displaced outwardly by axial upward movement of the anchor bolt 22 when a pulling force is exerted on the bolt 22 by flexion in the pole 11. This expansion shell grips the side wall of the bore hole and will permit slight axial movement of the entire harness assembly when under severe load, allowing the anchor bolts together with the harness to move slightly upward, thereby causing additional expansion of the shell 36 and increasing the holding power in its bore hole. However, the shell 36 does not move relative to the bore hole but merely expands preventing the bore hole from being expanded. The only movement in the hole is the bolt within the sleeve 35 and the channel section 15. The sleeve section 35 above the joint 36' will therefore loosen. The nut 26 can then be retightened to take up the slack between the bolt and the harness with the sleeve section 35 being placed back in contact between the joine 36' and the spacer 27.

Figure 6A:
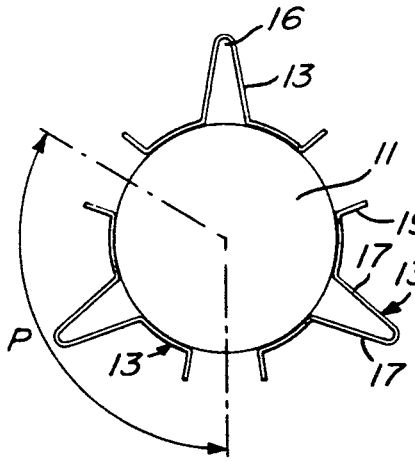
FIGS. 6A to 6C are plan views illustrating poles of varying diameter with harness assemblies having different numbers of harness elements.
Figure 6B:
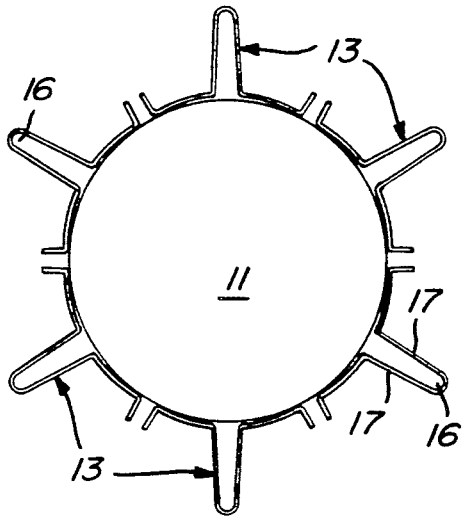
Figure 6C:
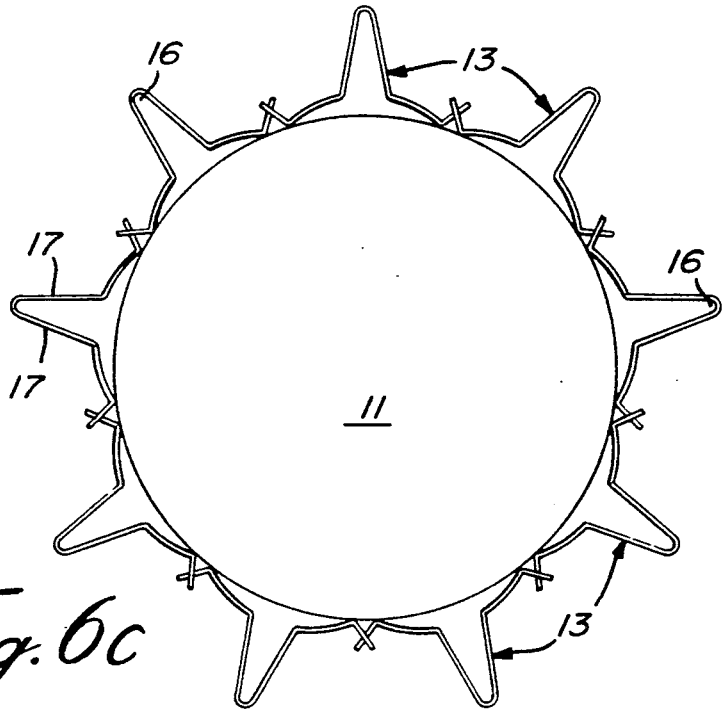

Although in the example herein described, there is shown a pole anchoring device having only three harness members 13 interconnected about the pole 11, it is pointed out that with larger diameter poles, there are more of these harness sections, for example, six or more sections, as shown in FIGS. 6A to 6C. It is further pointed out that the manner in which the harness members are interconnected together, the manner in which the anchor bolts are retained in the outermost part of the outer channel section 15, and the specific shape of the outer channel sections, can be varied without departing from the ambit of the present invention. It is also pointed out that by forming the harness members as described herein, welds are totally eliminated thus the entire pole anchoring device is stronger, easier to manufacture and less costly. Because the harness members are also symmetrical, they can be assembled in either direction.

As shown in FIG. 6A, there are three harness members 13 positioned about a pole 11 having a diameter of 19". Each modular harness member 13 has a pitch P of 15.75". By compressing the side walls 17 of the members 13 by the use of bolts 21 in holes 9, an additional harness member 13 can be provided about the pole increasing the resistance strength of the harness assembly, if desired. Of course, the connecting flanges 19 would be spaced closer together as shown in FIGS. 6B and 6C. These additional two figures show harness assemblies with many more members 13 disposed about their base section diameters. FIG. 6B is a pole of 26" diameter, while FIG. 6C illustrates a pole with a 43" diameter.

Tests of my new pole anchoring device 10 using the same diameter of anchor bolt, have been effectuated and compared with the test of my anchoring device as described in U.S. Pat. No. 4,218,858 and the resistance to bending moments or transverse load has been found to be improved by about tenfold (X10), this comparison having been made with a harness assembly having three harness elements only. If a fourth element 13 was to have been added to the assembly, the results would have been superior. The following table lists the test parameters and results of tests effectuated on a pole having a diameter of 19.5". The pole failed when reaching a load of 220.000 lbs.

| LOAD K | MOMENT AT BASE K-FT | DEFLECTION OF POLE (DEG) |
|---|---|---|
| 4 | 40 | 0.3 |
| 6 | 60 | 0.5 |
| 8 | 80 | 1.1 |
| 10 | 100 | 1.8 |
| 12 | 120 | 2.4 |
| 14 | 140 | 3.4 |
| 16 | 160 | 4.0 |
| 18 | 180 | 5.5 |
| 19 | 190 | 8.2 |
| 21 | 210 | 12.8 |

Summarizing the installation, we firstly determine the number of components or harness elements to be included in the harness assembly. The bore holes are drilled and the harness is assembled loosely about the pole base section with the anchor bolts in the bore holes. If necessary, some of the bolts 21 are disposed in the holes 9 to compress the side walls 17 of the channel sections 15. The curved sections 13 of the harness will conform to the surface of the pole and the lag bolts 30 are then driven into the pole to maintain the harness members 13 in position. The bolts 21 are then removed from the holes 9 and inserted in the holes of their respective pairs of connecting flanges 19 and tightened. The base of the pole 11 is sitting on the ground surface 12 and the jacket or harness is elevated surface.

Figure 8:
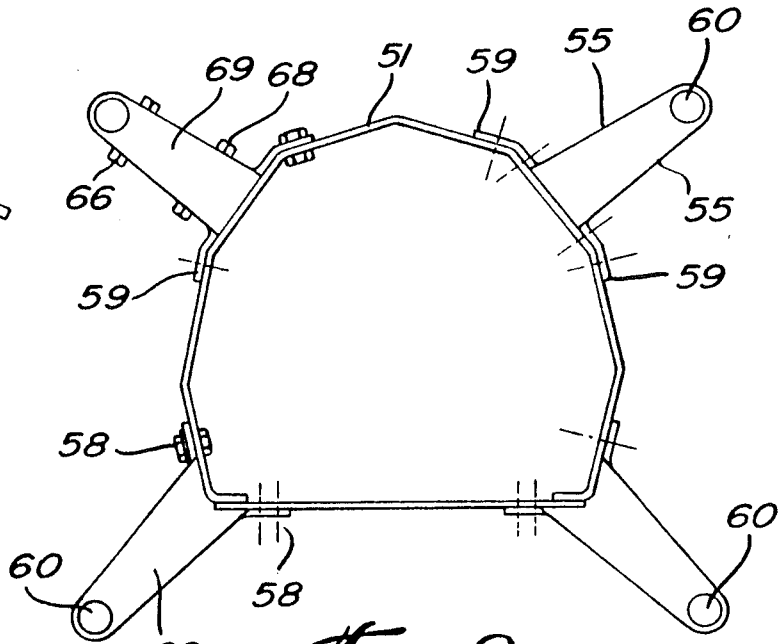
FIG. 8 is a plan view illustrating a plurality of pole anchoring members secured about a metal pole.
Figure 7:
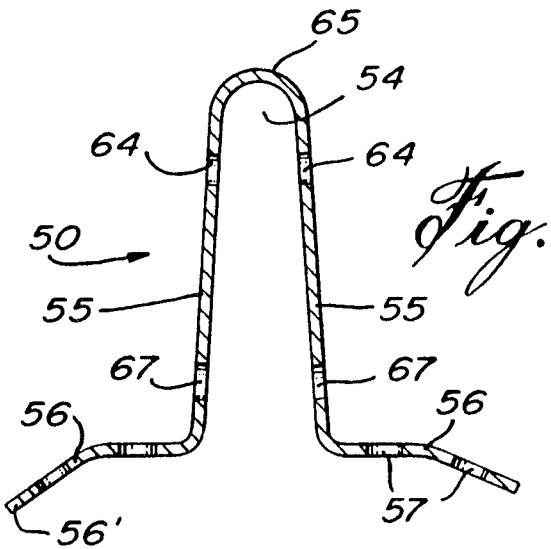
FIG. 7 is a cross-section view of a pole anchoring member for securement directly to a bottom outer section of a metal pole.
Figure 9:
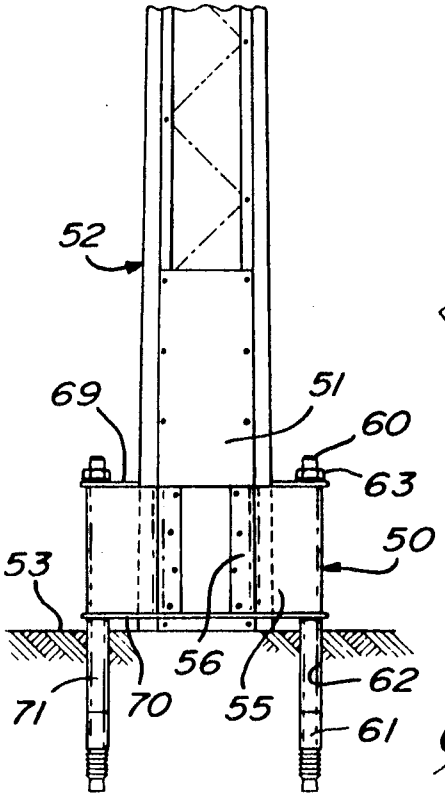
FIG. 9 is a side view showing the pole anchoring member secured about the bottom outer section of a metal pole and anchored into the hard ground surface.

Referring now to FIGS. 7 to 9, there will be described another embodiment of the present invention and, as hereinshown, the pole anchoring member 50 is secured directly to the bottom outer section 51 of a metal pole, such as metal pole 52, as shown in FIG. 9 whereby to support the pole 52 vertically over a hard ground surface 53 such as rock, concrete or the like.

The pole anchoring member 50, as shown in FIG. 7, is comprised of a metal steel plate which is bent to define an elongated U-shaped brace having a straight outer elongated trough portion 54 and outwardly tapering opposed side walls 55. The side walls 55 each have an outwardly angulated end section to define a pole connecting flange 56 on each side of the trough portion 54 for securing the anchoring member to the bottom outer section 51 of the metal pole. The connecting flanges 56, as shown in FIG. 7, are bent to the configuration of the metal pole outer wall to which it is required to be connected and may be provided with two or more holes 57 for receiving connecting bolts 58 to connect the anchoring member to the metal pole. Alternatively, the flanges 56 may be welded to the pole, as shown at 59 in FIG. 8, and this can be done by applying a weld bead all along the outer side edge 56' of the flanges and its top edge or wherever there is metal adjacent the contour edge of the flange.

After the anchoring member is secured to the metal pole, as shown in FIG. 9, elongated anchor bolts 60 are guidingly positioned in the outermost trough portion 54 and along an axis substantially parallel to the axis of the pole to anchor the pole vertically in the ground surface 53. As hereinshown, the anchor bolts are spaced a predetermined distance away from the bottom outer section 51 of the pole to provide more rigidity. The anchor bolts 60 are also provided with anchoring means 61 in the lower end portion thereof for anchoring into bore holes 62 formed in the hard surface. The anchor bolt 60 also extends through the trough portion of the brace 50 and is threaded to receive a securing nut 63 to impart axial displacement of the anchor bolt in an upward direction to actuate the anchoring means 61 whereby to anchor the lower end of the anchor bolt in the bore holes 62 and to support the pole vertically on the hard surface.

As shown in FIG. 8, the side walls 58 are further provided with holes 64 spaced a predetermined distance from the apex 65 of the trough portion 54 whereby to receive guide bolts 66 therein and extending across the opposed side walls 55 whereby to restrain a section of the anchor bolt in the trough outermost portion 54. Further holes 67 may be provided in the side walls 55 whereby to receive a restraining bolt 68 thereacross to further add rigidity to the side walls of the brace.

Abutment means in the form of washer plates 69 or large washers are disposed about the threaded end portion 60 of the anchoring bolts and abut against the top edge of the U-shaped brace to provide abutment for the nut 63 for the reason as previously described. A washer or plate 70 is also provided between the lower edges of the brace and the sleeve 71 positioned in the bore hole 62 for reasons as previously described with reference to FIGS. 1 to 6.

It is within the ambit of the present invention to cover any obvious modifications of the preferred embodiments described herein, provided such modifications fall within the scope of the appended claims.

I claim:

1. A pole anchoring device for supporting poles vertically over a hard surface such as rock, concrete or the like, said device comprising a harness assembly connected about a base section of a pole to be supported on said hard surface, connecting means to immovably secure said harness assembly about said base section, said harness assembly being comprised of harness members each having a pole engaging section for abutment against a pole and a bolt support section spaced outwardly from said pole engaging section, an anchor bolt guidingly positioned in said bolt support section of each said harness members and extending along an axis substantially parallel to the axis of said pole and spaced a predetermined distance away from said pole support section, anchoring means secured to said anchor bolt and disposed below said bolt support section, said anchor bolt having an engageable top end portion extending in a top section and partly above said bolt support section for engagement by a bolt engaging means to impart axial displacement of said anchor bolt in an upward direction to actuate said anchoring means to anchor a lower end of said anchor bolt in a bore hole in said hard surface and spaced adjacent said pole, said harness members being formed from a metal plate which is bent to define an outer elongated channel section constituting said bolt support section in a trough outermost portion thereof; said pole engaging section being defined by opposed wall sections, one on each side of said outer channel section.

2. A pole anchoring device as claimed in claim 1 wherein there is further provided arresting means to immovably secure said harness members to said pole, there being three or more of said harness members in said harness assembly.

3. A pole anchoring device as claimed in claim 2 wherein said arresting means is provided by one or more lag bolts disposed through one or more connecting holes provided in said pole engaging section of said harness members and extending into said pole.

4. A pole anchoring device as claimed in claim 1 wherein a connecting flange is formed at a free end of each said wall section, and holes in said connecting flanges to receive said connecting means therethrough.

5. A pole anchoring device as claimed in claim 4 wherein there is further provided at least one hole in each said opposed wall sections and aligned with one another to receive a bolt therethrough to compress said wall sections closer together to reduce the length of said harness element as measured between said connecting flanges thereby permitting additional harness elements to be included in a harness assembly.

6. A pole anchoring device as claimed in claim 4 wherein there are two vertically spaced apart holes in said opposed wall sections and aligned with one another.

7. A pole anchoring device as claimed in claim 4 wherein said connecting means is comprised by two or more spaced apart bolts secured through said holes in opposed connecting flanges of opposed harness members.

8. A pole anchoring device as claimed in claim 4 wherein there is further provided guide means to maintain said anchor bolt in said outermost portion of said outer channel section.

9. A pole anchoring device as claimed in claim 8 wherein said guide means is provided by two or more spaced apart guide bolts extending across opposed wall of said outer channel section spaced from the apex thereof whereby to restrain a section of said anchor bolt in said trough outermost portion.

10. A pole anchoring device as claimed in claim 4 wherein there is further provided abutment means at opposed ends of said outer channel section to provide abutment in a top end thereof for an anchor bolt head and to provide abutment in a bottom end thereof for a top end of a sleeve section of said anchoring means.

11. A pole anchoring device as claimed in claim 10 wherein said abutment means is a washer plate spaced close to at least a section of said bolt adjacent said trough outermost portion.

12. A pole anchoring device as claimed in claim 11 wherein said metal plate is a galvanized steel plate, said plate having a symmetrical shape, said outer channel section being formed as a V-shaped channel section with said opposed side walls being outwardly inclined, said opposed wall sections on each side of said outer channel section being concavely curved wall sections.

13. A pole anchoring device as claimed in claim 10 wherein said anchoring means further comprises a bottom expansion shell, said anchor bolt having a conical bottom end, said expansion shell being supported about said anchor bolt between said conical bottom end, said sleeve section of said anchoring means resting on top of said expansion shell and forming an isolation joint therebetween, said expansion shell having expansion wall sections with outer gripping means to grip a side wall of a bore hole made in said hard surface when said bolt is axially displaced outwardly by a pulling force exerted thereon thereby causing said conical bottom end to apply lateral pressure of said expansion shell.

14. A pole anchoring device as claimed in claim 13 wherein said sleeve section of said anchoring means is constructed of a thick steel gauge and extends outwardly of said bore holes a predetermined distance to maintain said harness spaced from a bottom end of said pole, said top end of said sleeve section of said anchoring means also resisting to lateral loads imparted to said pole.

15. A pole anchoring device as claimed in claim 1 wherein said engageable top end portion of said anchor bolt is a threaded top end portion, said bolt engaging means being a threaded nut engageable with said threaded top end portion.

16. A pole anchoring member for supporting metal poles vertically over a hard surface such as rock concrete or the like, said pole anchoring member comprising a metal plate bent to define an elongated U-shaped brace having a straight outer elongated trough portion and outwardly tapering opposed side walls, said side walls each having an outwardly angulated end section to define a pole connecting flange on each side of said trough portion for securement to a bottom outer section of a metal pole, an elongated anchor bolt guidingly receivable in and extending through said trough portion along an axis substantially parallel to the axis of a pole to be anchored by two or more of said pole anchoring members and spaced a predetermined distance away from said bottom outer section of said pole, said anchor bolt having anchoring means in a lower end portion thereof for anchoring in a bore hole formed in said hard surface, said anchor bolt further having an engageable top end portion extending above an outermost portion of said trough portion of said brace for engaging bolt engaging means to impart axial displacement of said anchor bolt in an upward direction to actuate said anchoring means to anchor a lower end of said anchor bolt in said bore hole and to support said pole vertically on said hard surface.

17. A pole anchoring member as claimed in claim 16 wherein said pole connecting flange is provided with two or more holes therein for receiving connecting bolts to connect same to said bottom outer section of said metal pole.

18. A pole anchoring member as claimed in claim 16 wherein said pole connecting flange is connected to said bottom outer section of said metal pole by a weld.

19. A pole anchoring member as claimed in claim 16 wherein said elongated anchor bolt is guidingly received in said trough by guide means.

20. A pole anchoring member as claimed in claim 19 wherein said guide means is provided by two or more spaced apart guide bolts extending across said opposed side walls of said trough portion and spaced from the apex thereof whereby to restrain a section of said anchor bolt in an outermost portion of said trough.

21. A pole anchoring member as claimed in claim 16 wherein there is further provided abutment means at opposed ends of said trough portion to provide abutment in a top end thereof for an anchor bolt head and to provide abutment in a bottom end thereof for a top end of a sleeve section of said anchoring means.

22. A pole anchoring member as claimed in claim 21 wherein said abutment means is a washer plate spaced close to at least a section of said anchor bolt adjacent said outermost portion of said trough portion.

* * * * *